US005970661A

United States Patent [19]

Bishop et al.

[11] Patent Number: 5,970,661

[45] Date of Patent: Oct. 26, 1999

[54] CHILDRENS PLAY STRUCTURE

[76] Inventors: John F. Bishop, 12025 Sugarland Valley; Elizabeth F. Bishop, 12025 Sugarland Valley, both of Herndon, Va. 20170-2604

[21] Appl. No.: 09/086,363

[22] Filed: May 28, 1998

[51] Int. Cl.[6] ..... E04B 1/34; E04H 15/02

[52] U.S. Cl. ..... 52/2.11; 52/2.22; 52/2.24; 52/63; 52/3; 52/DIG. 13; 52/2.25; 135/93; 135/125

[58] Field of Search ..... 52/2.11, 2.22, 52/2.24, 2.25, 63, DIG. 13, DIG. 14, 3; 135/93, 94, 124, 125

[56] References Cited

U.S. PATENT DOCUMENTS

| | | | |
|---|---|---|---|
| 1,167,249 | 1/1916 | Arel | 135/93 X |
| 2,939,467 | 6/1960 | Meyer et al. | 52/2.24 X |
| 3,059,657 | 10/1962 | Turner | 52/2.24 |
| 3,478,472 | 11/1969 | Kwake | 52/2.25 X |
| 3,898,775 | 8/1975 | Webb | 52/2.24 X |
| 4,094,021 | 6/1978 | Rapp | 52/DIG. 13 |
| 4,102,352 | 7/1978 | Kirkham | 135/93 X |
| 4,103,369 | 8/1978 | Riordan | 52/DIG. 13 X |
| 4,369,591 | 1/1983 | Vincino | 52/2.24 X |
| 4,567,696 | 2/1986 | Malet | 52/2.24 X |
| 4,625,468 | 12/1986 | Hampel | 52/2.24 |
| 4,887,627 | 12/1989 | Audet | 52/2.24 X |
| 5,145,440 | 9/1992 | Boris et al. . | |
| 5,273,477 | 12/1993 | Adams, Jr. . | |
| 5,313,747 | 5/1994 | Sakihara . | |
| 5,636,478 | 6/1997 | Chen . | |
| 5,706,613 | 1/1998 | Drake, Jr. et al. . | |
| 5,715,854 | 2/1998 | Andrieux et al. . | |

*Primary Examiner*—Carl D. Friedman
*Assistant Examiner*—Brian E. Glessner
*Attorney, Agent, or Firm*—Roland H. Shubert

[57] ABSTRACT

An air supported play structure that may be configured into a large variety of forms and shapes. An expanse of air-permeable fabric is weighted around its edges, and the fabric is supported above a surface by a stream of air supplied by a fan. A plurality of connectors are attached to the fabric, and those connectors are arranged to allow any one connector to be secured to another connector. The geometric configuration of the play structure is altered by changing the position of the edge weights, and by selecting the connectors to be secured one to another.

16 Claims, 3 Drawing Sheets

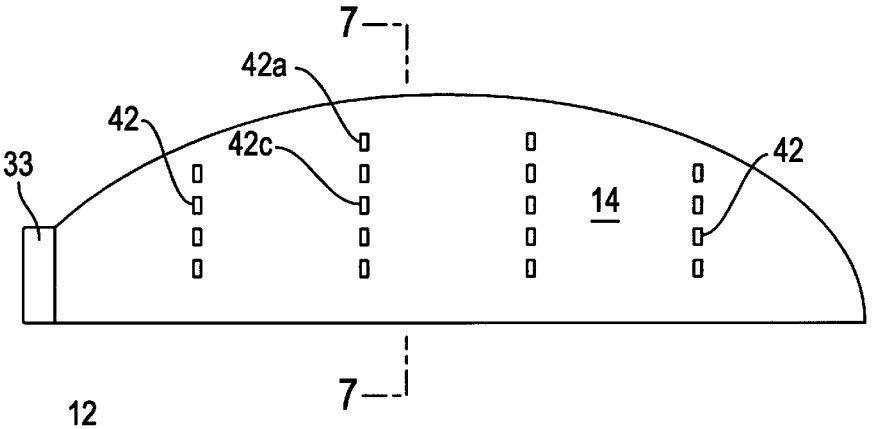
FIG. 6
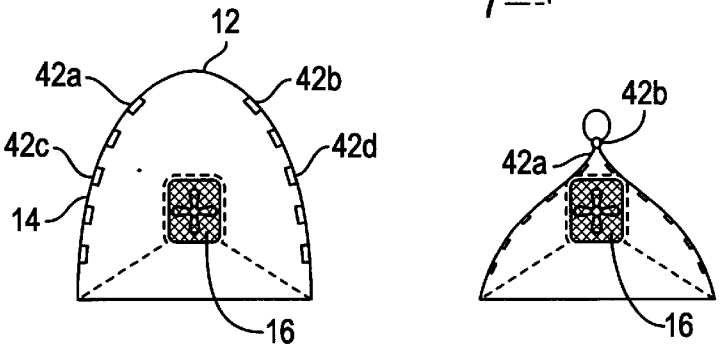
FIG. 7A
FIG. 7B
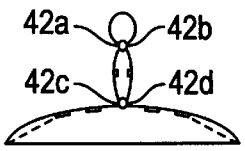
FIG. 7C
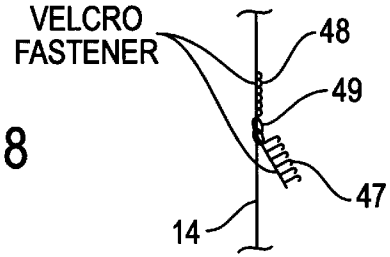
FIG. 8

CHILDRENS PLAY STRUCTURE

BACKGROUND OF THE INVENTION

1. Technical Field

This invention relates to a play structure that can be formed at will into an almost infinite number of geometric configurations. More specifically, this invention relates to a play structure that is formed of a generally planar expanse of air permeable fabric anchored about its perimeter to a surface, and supported by air pressure supplied by a fan.

2. Background Art

As every parent knows, children take delight in playing with and in playhouse structures, and a variety of such structures have been marketed over the years. Many of those play structures are patterned after conventional residential houses, usually including four walls, a roof and an entrance doorway. Often such play structures are of modular construction, allowing easy assembly for play and easy disassembly for storage. The collapsible playhouse that is described in U.S. Pat. No. 5,313,747 is an example of such play structures. Another similar playhouse is illustrated in the Drake, Jr. et al patent, U.S. Pat. No. 5,706,613. That patent describes a walk-in playhouse that is constructed of molded plastic wall panels and a roof. The playhouse also has a pair of pivotal, swing-out seats that are attached to a wall of the playhouse.

While many playhouses are patterned after conventional dwellings, other structural models are used as well. For example, U.S. Pat. No. 5,715,854 is directed to an igloo-like domed structure that is formed from a series of interlocking side panels of trapezoidal shape. The patent suggests that the structure is especially appropriate for winter play and may be used for other purposes, such as a hunting hut, as well.

Inflatable tubular passages have been used instead of conventional rod-like frame members to support a tent, and an example of such tent construction is set out in U.S. Pat. No. 5,636,478 Inflatable elements have also been used to construct childrens' play houses. An example of that approach is described in the patent to Boris et al, U.S. Pat. No. 5,145,440. That patent discloses a life size knockdown toy structure modeled after a log cabin. The cabin is formed from self interlocking, inflatable simulated logs. When not in use, the logs are deflated and stored in a relatively small container. Another play structure that uses inflatable elements is shown in U.S. Pat. No. 5,273,477 to Adams. Each inflatable element comprises a block having interlocking tongue and groove edge connections.

In spite of the elaborate play structures that are available, many parents have found that children will forego those fancy toys in favor of playing with empty packing cartons and the like. One reason for that preference is likely the freedom for imaginative play that is afforded by the cartons as contrasted to the relatively rigid and organized play patterns imposed by formal play structures.

In contrast to the rigidity of structure and use of previous play houses this invention provides a simple play structure that children can configure at will into an essentially endless variety of forms, thus reinforcing the imaginative elements of play.

SUMMARY OF THE INVENTION

This invention provides a play structure that is formed from a generally planar expanse of an air-permeable fabric. A plurality of connection means are attached to the fabric which is anchored to a floor or other surface by weights that are attached around the fabric perimeter. A shroud that is adapted to encircle the housing of a household fan is located at one point around the fabric edge, and is arranged to direct air flow from the fan to the underside of the fabric and suspend the fabric above the surface. The shape of the play structure is altered by changing the position of the weights and by attaching one of the connection means to another so as to obtain an essentially unlimited number of geometric configurations.

BRIEF DESCRIPTION OF THE DRAWING

FIG. 6 is a side view of the FIG. 1 structure showing one arrangement of connection means that can be used with the FIG. 1 structure;

FIG. 7A is a sectional view of the play structure taken along line 7—7 of FIG. 6;

FIG. 7B is the same sectional view as is FIG. 7A, but showing a change in shape obtained by attaching one connection means to another;

FIG. 7C is the same sectional view as is FIG. 7A, but showing another change in shape obtained by attaching a different pair of connection means, one to another; and FIG. 8 is a detail view of a preferred form of connection means.

DETAILED DESCRIPTION OF THE INVENTION

Figure 1:
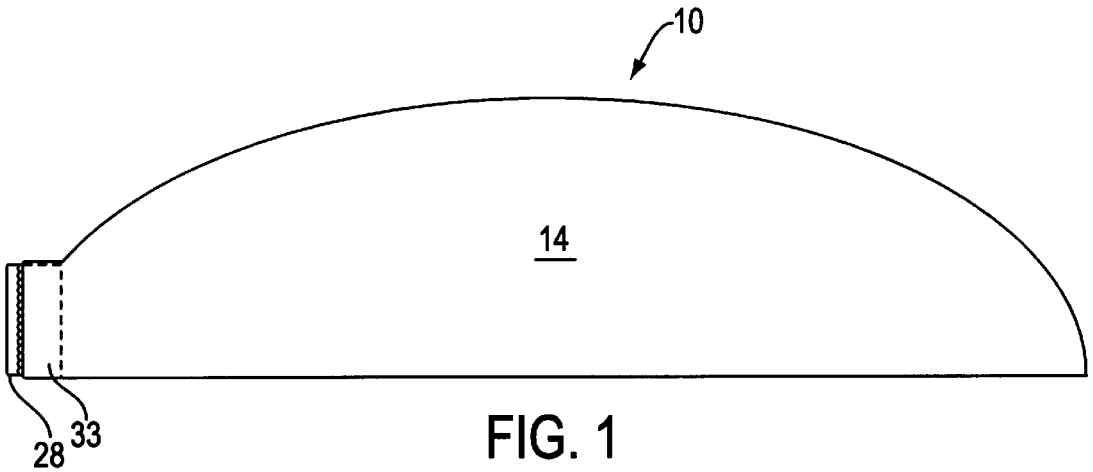
FIG. 1 is a side view of one embodiment of the play structure of this invention.
Figure 2:
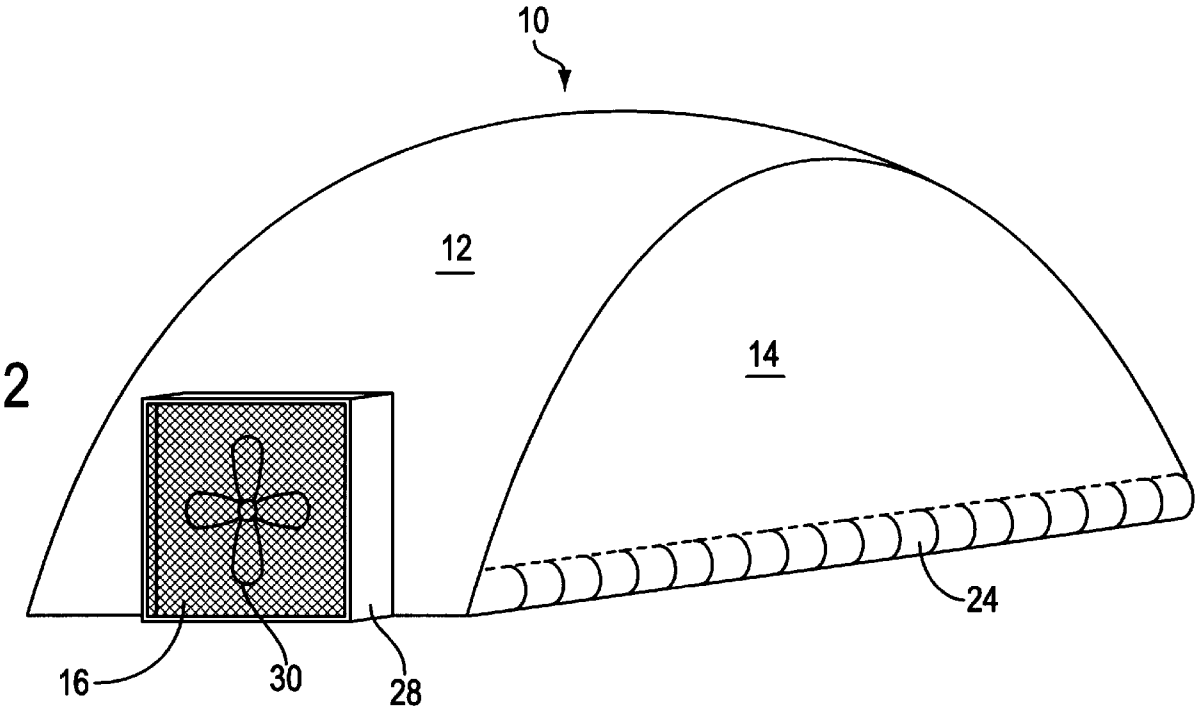
FIG. 2 is an oblique view of the embodiment of FIG. 1.
Figure 3:
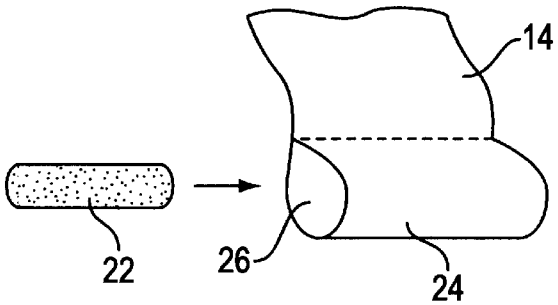
FIG. 3 is a detail of the weighting means that are arranged around the perimeter of the structure.

The play structure 10 as shown in FIGS. 1 and 2 may be constructed of a single expanse of fabric or, as is best shown in FIG. 2, may be formed of a middle fabric panel 12 and one or more side fabric panels 14. In use, structure 10 is disposed on a floor or other relatively flat surface, and is suspended above that surface by the force of air that is directed to the underside of the fabric by action of a fan 16. The perimeter of the fabric making up structure 10 is held adjacent the floor surface by anchor means which, in a preferred embodiment that is best shown in FIG. 3, consist of a plurality of weights 22 that fit into receptacles 24 formed at the fabric edge. Weights 22 conveniently may be formed as tubular sacks filled with sand or other particulate weighting material, and are sized to slide into pockets 26 that are formed as a loop at the free edges of panels 12 and 14.

Figure 4:
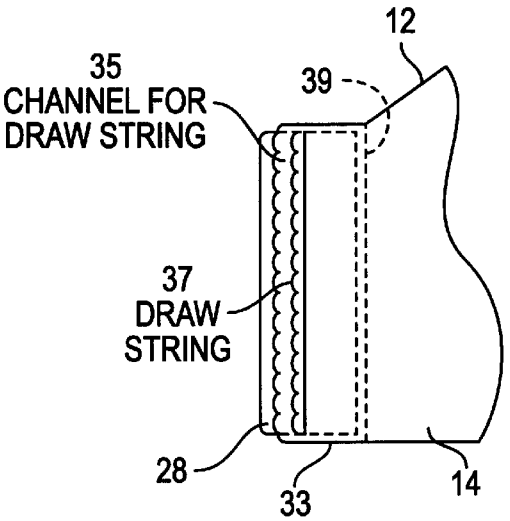
FIG. 4 is a side detail view showing an arrangement of the fan shroud of the FIG. 1 structure.

Fan 16 preferably is a conventional, electrically powered household fan, such as an ordinary box fan, having a housing 28 that encases the fan blades and motor assembly 30. The housing 28 of such a fan is typically rectangular, usually square, and is ordinarily some sixteen to twenty inches on a side. A shroud 33 is formed at a location along the free edge of the fabric that forms structure 10, preferably at the center edge of middle panel 12. Shroud 33 functions as a flexible and expansible tubular conduit that connects the exhaust side of the fan to the underside of the fabric panels making up structure 10. The outer end of shroud 33 may be formed much like the open end of a laundry bag that has a drawstring closure. As is best shown in FIG. 4, shroud 33 may comprise a tubular extension at the edge of structure 10 that is sized to fit around the outside of fan housing 28. A channel 35 is formed around the shroud circumference to contain either an elastomeric cord or a drawstring 37 for securely tightening the shroud about the fan housing. That arrangement allows fans of different sizes or with different housing shapes, rectangular or circular for example, to interchangeably connect to the play structure. Air flowing from the fan is thus directed to the underside of the fabric where it acts to suspend the fabric above the floor surface.

Figure 5:
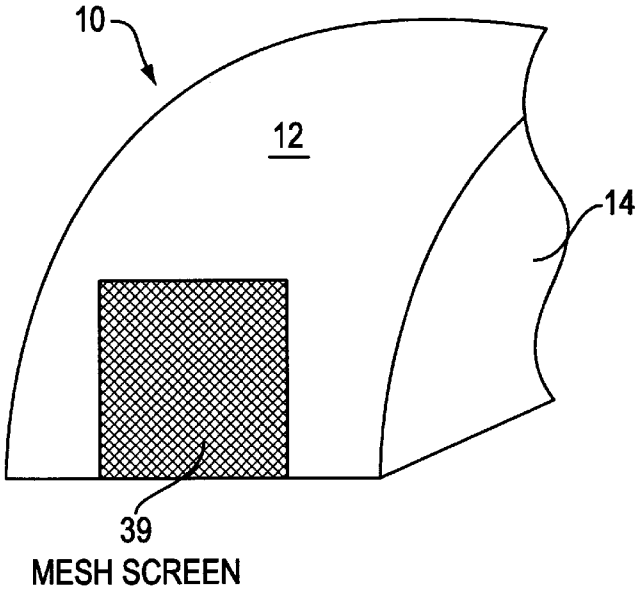
FIG. 5 is an oblique end view of the FIG. 1 structure with the shroud removed.

FIG. 5 comprises an end view of the play structure with the shroud removed, and illustrates one preferred embodiment of this invention. As is shown in FIGS. 4 and 5, a mesh screen 39 is fixedly positioned across the passageway formed by shroud 33 just downstream from and parallel to the exhaust side of fan 16. The screen openings are sized large enough to minimize resistance to air flow, but small enough to prevent a child from inserting a finger through the mesh and into possible contact with the rotating fan blades.

Turning now to FIG. 6 which, taken in consideration with FIGS. 7A, 7B, 7C and 8, depicts groupings of connectors 42 that are arrayed on the underside of panels 12 and 14 and illustrates the manner in which the connectors are used. FIGS. 7A, 7B and 7C are sectional views of play structure 10 taken generally along line 7—7 of FIG. 6, and show structure 10 as shaped by use of connectors 42. Connectors 42 comprise broadly means that allow one connector 42 to securely fasten to another connector 42. Suitable connector means 42 include snaps, cord ties and the like, but preferably connectors 42 consist of a hook and loop fastener that is sold under the trademark Velcro® and arranged as is shown in FIG. 8.

Connectors 42 may be secured to the inner or the outer surface of fabric panels 12 and 14 in a regular array of rows and columns as is depicted in FIG. 6. Such regularity is not required, however, and connectors 42 may instead be placed in a totally random arrangement or any combination of orderly placement and randomness. As has been set out before, any two of connectors 42 may be fastened together, resulting in a change to the geometric configuration of the play structure 10. FIGS. 7A, 7B and 7C are illustrative of the possibilities for effecting such changes. For example, were connectors 42*a* and 42*b* (FIG. 7A) to be fastened together, then the cross section of play structure 10 would assume the configuration shown in FIG. 7B. In similar fashion, were connectors 42*c* and 42*d* to also be fastened together, there would result the configuration shown in FIG. 7C. In addition to the geometric changes that can be obtained by fastening two of the connectors 42 together, other configurations of the structure 10 may be obtained by selective placement of anchor weights 22. Taken in combination, those two ways to change the configuration of structure 10 enables a child to create an almost infinite number of variations. While connectors 42 have been shown in the drawings as being attached to the inner, or underside surface of the fabric panels, those connectors may also be attached to the outer surface of the fabric panels, and will serve as well to effect a change in the configuration of the structure when two connectors are fastened together.

FIG. 8 illustrates a most preferred embodiment of connector 42. In this embodiment, each connector 42 comprises a hook area 47 and a loop area 48 joined by a hinge section 49. Either hook area 47 or loop area 48 is attached to the fabric, leaving the other area free. Doubling the free area over at the hinge 49 into contact with the attached area secures the connector 42 so that it does not catch on clothing when not fastened to another connector.

It is important to the safe use of this play structure that the fabric making up panels 12 and 14 be carefully selected. The weave of the fabric used must allow free passage of air so that a child can breathe without difficulty through the fabric in the event that air flow from the fan fails and the fabric settles onto the supporting surface. That requirement totally precludes the use of plastic films and other impermeable sheets. The suitability of a particular fabric for use in this invention can be empirically determined through a simple test. Generally speaking if a person can breathe without difficulty through multiple fabric layers, at least three, then that fabric is sufficiently permeable for use. Also, it is generally desirable to select a fabric that is at least semi-translucent to light so as to minimize any claustrophobic feelings of those playing in the structure.

As can be appreciated, another significant advantage offered by the play structure of this invention is its ease of assembly, disassembly and storage. Assembly of the play structure requires only that the shroud be attached to the housing of a fan, and that anchor weights be placed in the pockets around the fabric perimeter. The fan is then turned on, and the structure is ready for use. Stowing the structure after use is equally simple. The fan is turned off, and the shroud disconnected. Anchor weights are then retrieved, and the fabric expanse is folded into a compact bundle. Space requirements for storage are minimal.

To more fully illustrate a practical embodiment of this invention, a play structure like that illustrated in FIGS. 1 and 2 was constructed of light gauge nylon fabric. Middle panel 12 was generally rectangular in shape, and measured about 4 feet wide and 20 feet long. Two identical side panels 14 were cut from a single elliptical-shaped piece of the same fabric that measured about 8 feet on its minor axis and about 15 feet along its major axis, the cut bisecting the fabric piece along its major axis. The curved side of each side panel was attached to the edges of the middle panel by sewing.

A shroud sized to accommodate a 20-inch box fan was centered at one end of the middle panel 12 in the manner shown in FIG. 2, and was secured around the fan housing. About fifteen short sections of flexible tubes, each containing about a half pound of sand, were placed in cylindrical pockets formed at the free edges of the middle and side panels, and the placement of those sand weights determined the configuration of the structure's perimeter. The fan was then turned on, and the fabric panels were then suspended by air flow produced by the fan.

In use, children enter and leave the structure at any point around its perimeter simply by lifting the fabric and climbing under it. The shape of the structure is adjusted at will merely by moving the sand tube weights. For example, moving the sand tubes into a FIG.-8 configuration creates two rooms in the structure that are separated by an oval doorway. In similar fashion, an L-shaped structure can be formed by placement of the sand tube weights so that the back portion of the structure is oriented at right angles to the front. As can be appreciated, a wide variety of other structure shapes, varying its height, length and width, can be obtained by creative placement of the sand tube weights. Other geometric configurations were obtained by fastening the fabric panels together between two different points in the manner shown in FIGS. 7B and 7C.

A number of specific and preferred embodiments of the invention have been described with particularity, but it is evident that other changes and modifications to the described invention will be apparent to those of ordinary skill in the art. Accordingly, it is to be understood that other variations in size, materials, construction and use that are readily apparent, or equivalent to those disclosed in this application, are considered to be within the scope of this invention and the appended claims.

We claim:

1. A play structure comprising:

an expanse of air permeable fabric deployed above a surface that is separate from said fabric to form an enclosed space bounded by said fabric and said surface;

a plurality of anchor weights arranged about the perimeter of said fabric;

a plurality of connectors attached to that surface of said fabric which is within said enclosed space, each said connector adapted to fasten to another of said connectors, said connectors arranged such that the shape of said structure is changed when one said connector is fastened to another said connector; and a shroud sited at an edge of said fabric, said shroud comprising a tubular conduit having a flexible and expansible opening that is sized to fit around a housing that encases the blades and motor assembly of a household fan, said conduit arranged to direct air from the fan into said enclosed space, said directed air adapted to be the sole support for said fabric.

2. The play structure of claim 1 wherein each said connector is a hook and loop connector.

3. The play structure of claim 2 wherein each said connector includes a hook area and a loop area joined by hinge means, and arranged with either the hook area or the loop area attached to said fabric, leaving the other area free.

4. The play structure of claim 1 wherein said connectors are arranged in a regular array of rows and columns on said fabric surface.

5. The play structure of claim 1 wherein said connectors are arranged randomly on said fabric surface.

6. The play structure of claim 1 wherein said anchor weights fit into receptacles formed at the fabric edge.

7. The play structure of claim 6 wherein said weights are formed as tubular sacks filled with a particulate weighting material, each said sack arranged to removably fit within a pocket that is formed as a loop at the fabric edge.

8. The play structure of claim 1 including a fan having a housing that encases its blades and motor assembly, wherein said shroud opening includes means to secure said shroud to said fan housing, and screen means between said fan housing and said enclosed space, the openings in said screen being smaller than a child's finger.

9. The play structure of claim 8 wherein said shroud is generally circular in cross section and wherein said securing means comprise a channel around the circumference of said tubular shroud, and means within said channel for tightening said shroud about the fan housing.

10. The play structure of claim 9 wherein said tightening means is an elastomeric cord.

11. The play structure of claim 1 wherein said fabric is sufficiently permeable to air that a person can breathe without difficulty through a least three fabric layers.

12. The play structure of claim 11 wherein said fabric is a light gauge nylon.

13. A play structure comprising an expanse of air permeable fabric deployed on a surface to form an enclosed space that is bounded by said fabric and said surface; means to direct air from a fan into said enclosed space; a plurality of connectors attached to that surface of said fabric which is within said enclosed space, each said connector adapted to fasten to another of said connectors, said connectors arranged such that the shape of said structure is changed when one said connector is fastened to another said connector; and movable means to anchor the edges of said fabric to said surface, said movable anchor means comprising a plurality of weights that fit into receptacles formed at the fabric edge.

14. The play structure of claim 13 wherein said fabric expanse is formed from a plurality of panels joined together, and wherein said air directing means comprise a tubular shroud that is arranged to convey air from said fan to the enclosed space.

15. The play structure of claim 14 wherein said fabric expanse is formed from a middle panel of generally rectangular shape and two side panels, and wherein said shroud is placed at one end of said middle panel.

16. The play structure of claim 13 wherein said fabric is a light gauge nylon having sufficient air permeability to allow a person to breathe through multiple layers of said fabric.

* * * * *